US007673489B2

(12) United States Patent
Otaki et al.

(10) Patent No.: US 7,673,489 B2
(45) Date of Patent: Mar. 9, 2010

(54) FORGING METHOD, FORGED ARTICLE AND FORGING APPARATUS

(75) Inventors: Atsushi Otaki, Oyama (JP); Hidemitsu Hamano, Oyama (JP)

(73) Assignee: Showa Denko K.K., Tokyo (JP)

( * ) Notice: Subject to any disclaimer, the term of this patent is extended or adjusted under 35 U.S.C. 154(b) by 536 days.

(21) Appl. No.: 10/576,470

(22) PCT Filed: Oct. 20, 2004

(86) PCT No.: PCT/JP2004/015878

§ 371 (c)(1),
(2), (4) Date: Jan. 26, 2007

(87) PCT Pub. No.: WO2005/037459

PCT Pub. Date: Apr. 28, 2005

(65) Prior Publication Data

US 2007/0107484 A1 May 17, 2007

Related U.S. Application Data

(60) Provisional application No. 60/513,990, filed on Oct. 27, 2003.

(30) Foreign Application Priority Data

Oct. 21, 2003 (JP) ..... 2003-360934

(51) Int. Cl.
*B21J 13/00* (2006.01)

(52) U.S. Cl. ..... 72/355.6; 72/353.2

(58) Field of Classification Search ..... 72/352–359
See application file for complete search history.

(56) References Cited

U.S. PATENT DOCUMENTS

| | | | | |
|---|---|---|---|---|
| 1,434,190 | A * | 10/1922 | Bird | 72/329 |
| 5,626,522 | A * | 5/1997 | Nielsen | 470/141 |
| 6,427,326 | B1 * | 8/2002 | Soga et al. | 29/888.092 |
| 7,406,852 | B2 * | 8/2008 | Otaki | 72/359 |
| 2004/0046142 | A1 * | 3/2004 | Wilson et al. | 251/129.15 |
| 2006/0053935 | A1 * | 3/2006 | Sawada et al. | 74/493 |

FOREIGN PATENT DOCUMENTS

| | | | |
|---|---|---|---|
| DE | 44 16 472 | A1 | 11/1995 |
| JP | 33-8053 | | 9/1958 |
| JP | 48-62646 | | 9/1973 |
| JP | 5-237584 | | 9/1993 |
| JP | 9-253782 | | 9/1997 |
| JP | 2000144211 | A * | 5/2000 |
| JP | 2003-170238 | | 6/2003 |
| WO | 93/17810 | | 9/1993 |

* cited by examiner

*Primary Examiner*—Dana Ross
*Assistant Examiner*—Stephanie Jennings
(74) *Attorney, Agent, or Firm*—Oblon, Spivak, McClelland, Maier & Neustadt, L.L.P.

(57) ABSTRACT

An axial intermediate portion of raw material is held with a holding die in a state in which the intermediate portion is prevented from being enlarged in diameter. The axial end portions of the raw material is inserted in forming dented portions formed at axial end portions of the holding die. The scheduled diameter-enlarging portions are inserted in insertion passages formed in guides. Then, the scheduled diameter-enlarging portions are simultaneously pressed with punches to fill the material of the scheduled diameter-enlarging portions in corresponding forming dented portion while moving each guide in a direction opposite to a moving direction of each punch, thereby enlarging each scheduled diameter-enlarging portion.

9 Claims, 10 Drawing Sheets

FORGING METHOD, FORGED ARTICLE AND FORGING APPARATUS

This application claims priority to Japanese Patent Application No. P2003-360934 filed on Oct. 21, 2003 and U.S. Provisional Application No. 60/513,990 filed on Oct. 27, 2003, the entire disclosures of which are incorporated herein by reference in their entireties.

CROSS REFERENCE TO RELATED APPLICATIONS

This application is an application filed under 35 U.S.C. §111(a) claiming the benefit pursuant to 35 U.S.C. §119(e)(1) of the filing date of U.S. Provisional Application No. 60/513,990 filed on Oct. 27, 2003 pursuant to 35 U.S.C. §111(b).

TECHNICAL FIELD

The present invention relates to a forging method, a forged article and a forging apparatus. More specifically, the preferred embodiments relate to a forging method for enlarging the diameter of both axial end portions of a bar-shaped raw material by upsetting the end portions, a forged article obtained by the method, and a forging apparatus for executing the forging method.

BACKGROUND ART

The following description sets forth the inventor's knowledge of related art and problems therein and should not be construed as an admission of knowledge in the prior art.

In general, upsetting is one of processing performed by applying pressure to a raw material in the axial direction thereof to thereby enlarge a diameter of a predetermined portion of the raw material. An improvement of such upsetting is known by Japanese Unexamined Laid-open Patent Publication No. 48-62646 (see pages 1 and 2, FIGS. 1 to 4).

In the conventional upsetting method, in cases where an enlarged diameter portion is to be formed at both axial end portions of a raw material, respectively, the following can be proposed. That is, after an enlarged diameter portion is formed at one axial end portion of the raw material, the raw material is reversed. Then, another enlarged diameter portion is formed at the other axial end portion.

In this proposed method, however, in cases where a member having enlarged diameter portions at both axial end portions (e.g., automobile arm members or automobile shaft members, or compressor double-leaded pistons) is manufactured, the number of steps for manufacturing the member increases, resulting in an increased manufacturing cost.

Furthermore, in general, according to an upsetting method, as shown in FIG. 10, unfilled portions 52 and 52 (i.e., portions where no material of the raw material 55 is filled) may generate at corner portions of the forming dented portion 51 of a female die 50 at the later stage of the processing. If such unfilled portions 52 generate, the obtained forged article becomes defective in shape (e.g., insufficient material defect), which deteriorates the value as a product. Accordingly, if the forming pressure is increased by increasing the pressing force with the punch 53 for the purposed of forcibly filling the material of the raw material 55 in the unfilled portions 52 and 52, an increased larger load will be applied to the forming dented portion 51 of the female die 50. This shortens durability of the female die 50.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

DISCLOSURE OF INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments can provide a forging method capable of efficiently manufacturing a forged article having an enlarged diameter portion at both end portions respectively and also preventing generation of shape defects of the forged article.

Among other potential advantages, some embodiments can provide a forged article obtained by the aforementioned method.

Among other potential advantages, some embodiments can provide a forging apparatus preferably used to perform the aforementioned method.

According to the present invention, the following means will be provided.

[1] A forging method for enlarging scheduled diameter-enlarging portions located at axial end portions of a bar-shaped raw material by upsetting, includes the steps of:

holding an axial intermediate portion of the raw material with a holding die in a state in which the axial intermediate portion is prevented from being enlarged in diameter, disposing the axial end portions of the raw material in forming dented portions formed at axial end portions of the holding die, and disposing the scheduled diameter-enlarging portions in insertion passages formed in guides; and then simultaneously pressing the scheduled diameter-enlarging portions with punches to fill the material of the scheduled diameter-enlarging portions in the forming dented portions while moving each glide in a direction opposite to a moving direction of each punch, thereby enlarging each scheduled diameter-enlarging portion in diameter.

[2] The forging method as recited in the aforementioned Item [1], wherein the insertion passage of each guide is configured to hold the scheduled diameter-enlarging portion in a buckle preventing state.

[3] The forging method as recited in the aforementioned Item [1] or [2], wherein an initial clearance having a distance less than a buckle limit length at a cross-sectional area of an exposed portion of the material is set between each guide and the holding die before initiation of movement of each punch.

[4] The forging method as recited in the aforementioned Item [3], wherein a time-lag is set between initiation of movement of each punch and initiation of movement of each guide.

[5] The forging method as recited in any one of the aforementioned Items [1] to [4], wherein each guide is provided with a pressing portion to be fitted in the forming dented portion at a tip end portion of the guide.

[6] The forging method as recited in any one of the aforementioned Items [1] to [5], wherein an insertion passage side edge portion of a tip end of each guide and/or an edge portion of a raw material fitting aperture of the holding die for fitting the axial intermediate portion of the raw material are chamfered.

[7] A forged article obtained by the forging method as recited in any one of the aforementioned Items [1] to [6].

[8] An automobile arm member obtained by the forging method as recited in any one of the aforementioned Items [1] to [6].

[9] An automobile shaft member obtained by the forging method as recited in any one of the aforementioned Items [1] to [6].

[10] An automobile connecting rod obtained by the forging method as recited in any one of the aforementioned Items [1] to [6].

[11] A two-headed piston for compressors obtained by the forging method as recited in any one of the aforementioned Items [1] to [6].

[12] A forging apparatus for enlarging scheduled diameter-enlarging portions of axial end portions of a bar-shaped raw material by upsetting, comprising:

a holding die for holding an axial intermediate portion of the raw material in a buckle preventing state;

two forming dented portions in which the scheduled diameter-enlarging portion is to be disposed, the forming dented portions being formed at axial end portions of the holding die;

two guides each having an insertion passage in which the scheduled diameter-enlarging portion is inserted; and two punches for pressing the scheduled diameter-enlarging portions in axial direction thereof, wherein each guide is capable of moving in a direction opposite to a moving direction of each punch.

[13] The forging apparatus as recited in the aforementioned Item [12], further comprising two guide moving devices each for moving the guide in a direction opposite to a moving direction of the punch, each guide moving device being connected to corresponding guide.

[14] The forging apparatus as recited in the aforementioned Items [12] or [13], wherein the insertion passage of each guide is configured to hold the scheduled diameter-enlarging portion in a buckle preventing state.

[15] The forging apparatus as recited in any one of the aforementioned Items [12] to [14], wherein each guide is provided with a pressing portion to be fitted in a forming dented portion at a tip end portion of the guide.

[16] The forging apparatus as recited in any one of the aforementioned Items [12] to [15], wherein an insertion passage side edge portion of a tip end of each punch and/or an edge portion of a raw material fitting aperture of the holding die for fitting the axial intermediate portion are chamfered.

According to the invention as recited in Item [1], by simultaneously pressing the scheduled diameter-enlarging portions located at axial end portions of a bar-shaped raw material while filling the material of each scheduled diameter-enlarging portion in corresponding forming dented portion, both the scheduled diameter-enlarging portions are simultaneously enlarged in diameter. Therefore, a forged article having enlarged diameter portions at both axial end portions can be efficiently formed, resulting in a reduced manufacturing cost.

Furthermore, by moving each guide in a direction opposite to a moving direction of corresponding punch while filling the material in the forming dented portion, the material flow in the forming dented portion is dispersed. Therefore, the material can be filled in the corner portions of the forming dented portion, or it is possible to prevent the problem of causing unfilled portion in the forming dented portion, without excessively increasing the forming pressure. Accordingly, a high quality forged article can be obtained.

Furthermore, by moving each guide in a direction opposite to a moving direction of respective punch, the load to be applied to the forming dented portion can be decreased. As a result, the durability of the forming dented portion can be extended.

According to the invention as recited in Item [2], the insertion passage of each guide is configured to hold the scheduled diameter-enlarging portion in a buckle preventing state. Therefore, a possible buckle of the diameter-enlarging portion which may occur at the time of pressing the diameter-enlarging portion with the punch can be prevented, which in turn can prevent the occurrence of shape-defects such as wrinkles or tucking. As a result, a forged article with higher quality can be obtained.

According to the invention as recited in Item [3], since an initial clearance having a predetermined distance is set between each guide and the holding die before initiation of movement of each punch (i.e., before the initiation of pressing of the scheduled diameter-enlarging portion with each punch), it is possible to prevent defects that the exposed portion of the raw material exposed within the initial clearance between each guide and the holding die immediately after the initiation of movement of each punch (i.e., immediate after the initiation of the pressing of the scheduled diameter-enlarging portion with each punch). Furthermore, the moving length (i.e., stroke) of each guide can be shortened.

According to the invention as recited in Item [4], since a time-lag is set between initiation of movement of each punch and initiation of movement of each guide, the cross-sectional area of the exposed portion of the raw material increases immediately after the initiation of movement of each punch (i.e., immediately after the initiation of pressing of the scheduled diameter-enlarging portion of the raw material with the punch). This assuredly prevents occurrence of buckle of the raw material.

According to the invention as recited in Item [5], since each guide is provided with a pressing portion to be fitted in the forming dented portion at a tip end portion of the guide, the material filled in the forming dented portion is pressed with the pressing portion at the time of the upsetting. Therefore, the material can be assuredly filled in the corner portions of the forming dented portion, which in turn can assuredly prevent occurrence of defects which may generate a material-unfilled portion in the forming dented portion. As a result, a forged article with high quality can be obtained.

Furthermore, when the pressing portion of the guide is fitted in the forming dented portion, the forming dented portion will be closed. Therefore, the forging method of this invention is classified into a closed upsetting forging method. As a result, it is not necessary to execute burr removing processing after the upsetting. This decrease the number of steps and improves the manufacturing efficiency.

According to the invention as recited in Item [6], since the insertion passage side edge portion of a tip end of each guide is chamfered, the guide receives the back-pressure of the material in the forming dented portion at the time of processing. As a result, the driving force required to move the guide in a predetermined direction can be decreased. Thus, the guide can be moved with smaller driving force. Furthermore, since the edge portion of the material fitting aperture of the holding die is chamfered, the stress concentration which may occur at a corner portion between the axial intermediate portion and the enlarged diameter portion of the forged article can be decreased.

According to the invention as recited in any one of Item [7], a forged article with high quality can be provided at low cost.

According to the invention as recited in any one of Item [8], an automobile arm member with high quality can be provided at low cost.

According to the invention as recited in Item [9], an automobile shaft member with high quality can be provided at low cost.

According to the invention as recited in Item [10], an automobile connecting rod with high quality can be provided at low cost.

According to the invention as recited in Item [11], a high-quality two-headed piston for compressors can be provided at low cost.

According to the invention as recited in Item [12], since the forging apparatus includes a holding die, two forming dented portions, two guides and two punches, it can be preferably utilized in the forging method according to the aforementioned invention.

According to the invention as recited in Item [13], since the forging apparatus further includes two guide moving devices, the aforementioned forging method of the invention can be performed assuredly by using the forging apparatus.

According to the invention as recited in Item [14], since the insertion passage of each guide is configured to hold the scheduled diameter-enlarging portion in a buckle preventing state, in the same manner as in Item [2], a possible buckle of the diameter-enlarging portion which may occur at the time of pressing the diameter-enlarging portion with the punch can be prevented, which in turn can prevent the occurrence of shape-defects such as wrinkles or tucking. As a result, a forged article with higher quality can be obtained.

According to the invention as recited in Item [15], since each guide is provided with a pressing portion to be fitted in a forming dented portion at a tip end portion of the guide, in the same manner as in Item [5], the material filled in the forming dented portion is pressed with the pressing portion at the time of the upsetting. Therefore, the material can be assuredly filled in the corner portions of the forming dented portion, which in turn can assuredly prevent occurrence of defects which may generate a material-nonfilled portion in the forming dented portion. As a result, a forged article with high quality can be obtained.

Furthermore, when the pressing portion of the guide is fitted in the forming dented portion, the forming dented portion will be closed. Therefore, the forging method of this invention is classified into a closed upsetting forging method. As a result, it is not necessary to execute burr removing processing after the swaging processing. This decreases the number of steps and improves the manufacturing efficiency.

According to the invention as recited in Item [16], since the insertion passage side edge portion of a tip end of each punch is chamfered, in the same manner as in Item [6], the guide receives the back-pressure of the material in the forming dented portion at the time of processing. As a result, the driving force required to move the guide in a predetermined direction can be decreased. Thus, the guide can be moved with smaller driving force. Furthermore, since the edge portion of the material fitting aperture of the holding is chamfered, the stress concentration which may occur at a corner portion between the axial intermediate portion and the enlarged diameter portion of the forged article can be decreased.

The effects of the invention can be briefly summarized as follows.

According to the invention as recited in Item [1], a forged article having enlarged diameter portions at both axial end portion can be efficiently formed, resulting in a reduced manufacturing cost. Furthermore, since it is possible to prevent the problem of causing material unfilled portion in the forming dented portion without excessively increasing the forming pressure, a high quality forged article can be obtained. Furthermore, since the forming pressure can be decreased, the durability of the forming dented portion can be extended.

According to the invention as recited in Item [2], a possible buckle of the diameter-enlarging portion which may occur at the time of pressing the diameter-enlarging portion with the punch (i.e. at the time of unsetting) can be prevented, which in turn can prevent the occurrence of shape-defects such as wrinkles or tucking. As a result, a forged article with higher quality can be obtained.

According to the invention as recited in Item [3], it is possible to prevent defects that the exposed portion of the raw material exposed within the initial clearance between each guide and the holding die immediately after the initiation of movement of each punch (i.e., immediate after the initiation of the pressing of the scheduled diameter-enlarging portion with each punch). Furthermore, the moving length (i.e., stroke) of each guide can be shortened.

According to the invention as recited in Item [4], the buckle limit length of the exposed portion of the raw material can be increased immediately after the initiation of movement of each punch, the occurrence of buckle of the raw material can be prevented assuredly.

According to the invention as recited in Item [5], the material can be assuredly filled in the corner portions of the forming dented portion, which in turn can assuredly prevent occurrence of defects which may generate a material-unfilled portion in the forming dented portion. As a result, a forged article with high quality can be obtained. Furthermore, it is not necessary to execute burr removing processing after the upsetting, and therefore the number of steps can be decreased and the manufacturing efficiency can be increased.

According to the invention as recited in Item [6], since the insertion passage side edge portion of a tip end of each guide is chamfered, the driving force required to move the guide in a predetermined direction can be decreased. Thus, the guide can be moved with smaller driving force. Furthermore, since the edge portion of the material fitting aperture of the holding die is chamfered, the stress concentration which may occur at a corner portion between the axial intermediate portion and the enlarged diameter portion of the forged article can be decreased.

According to the invention as recited in any one of Item [7], a forged article with high quality can be provided at low cost.

According to the invention as recited in any one of Item [8], an automobile arm member with high quality can be provided at low cost.

According to the invention as recited in Item [9], an automobile shaft member with high quality can be provided at low cost.

According to the invention as recited in Item [10], an automobile connecting rod with high quality can be provided at low cost.

According to the invention as recited in Item [11], a high quality two-headed piston for compressors can be provided at low cost.

According to the invention as recited in Item [12], a forging apparatus which can be preferably utilized in the forging method according to the aforementioned invention can be provided.

According to the invention as recited in Item [13], a forging apparatus which can assuredly perform the forging method of the invention can be provided.

According to the invention as recited in Item [14], a forging apparatus which can assuredly perform the forging method of the invention as recited in Item [2] can be provided.

According to the invention as recited in Item [15], a forging apparatus which can assuredly perform the forging method of the invention as recited in Item [5] can be provided.

According to the invention as recited in Item [16], a forging apparatus which can assuredly perform the forging method of the invention as recited in Item [6] can be provided.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Figure 1:
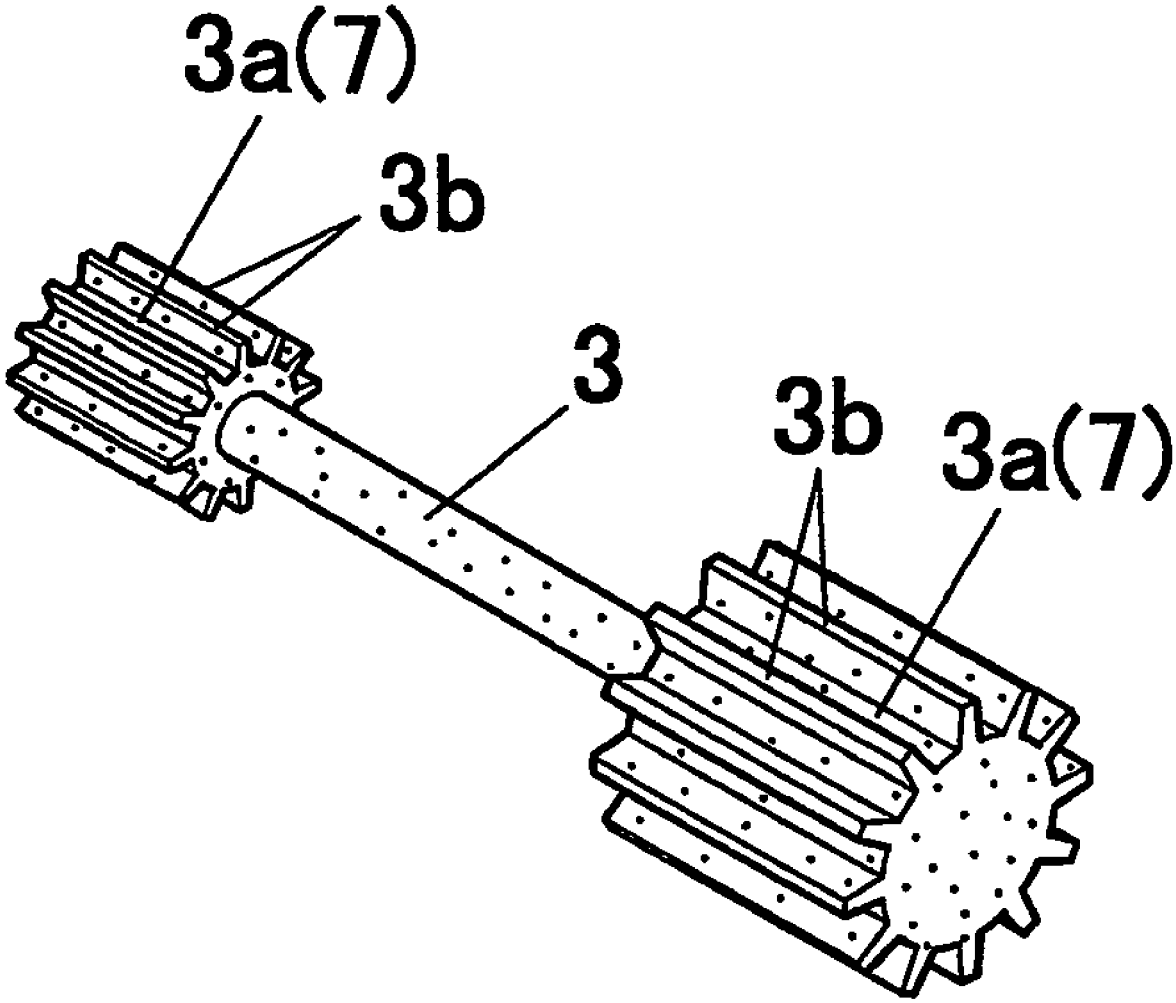
FIG. 1 is a perspective view showing a forged article manufactured by a forging apparatus according to an embodiment of the present invention.
Figure 2:
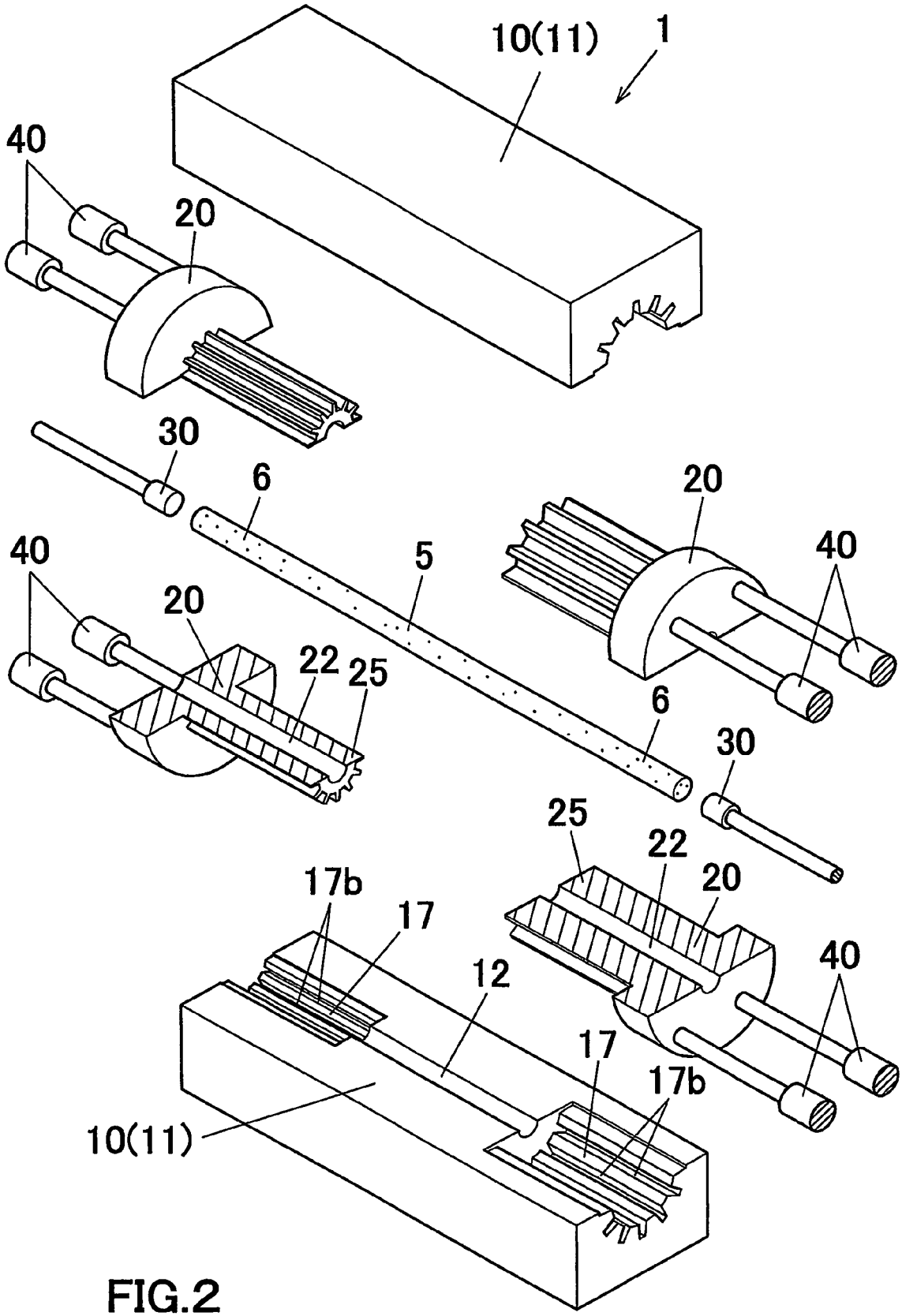
FIG. 2 is an exploded perspective view of the forging apparatus.
Figure 3:
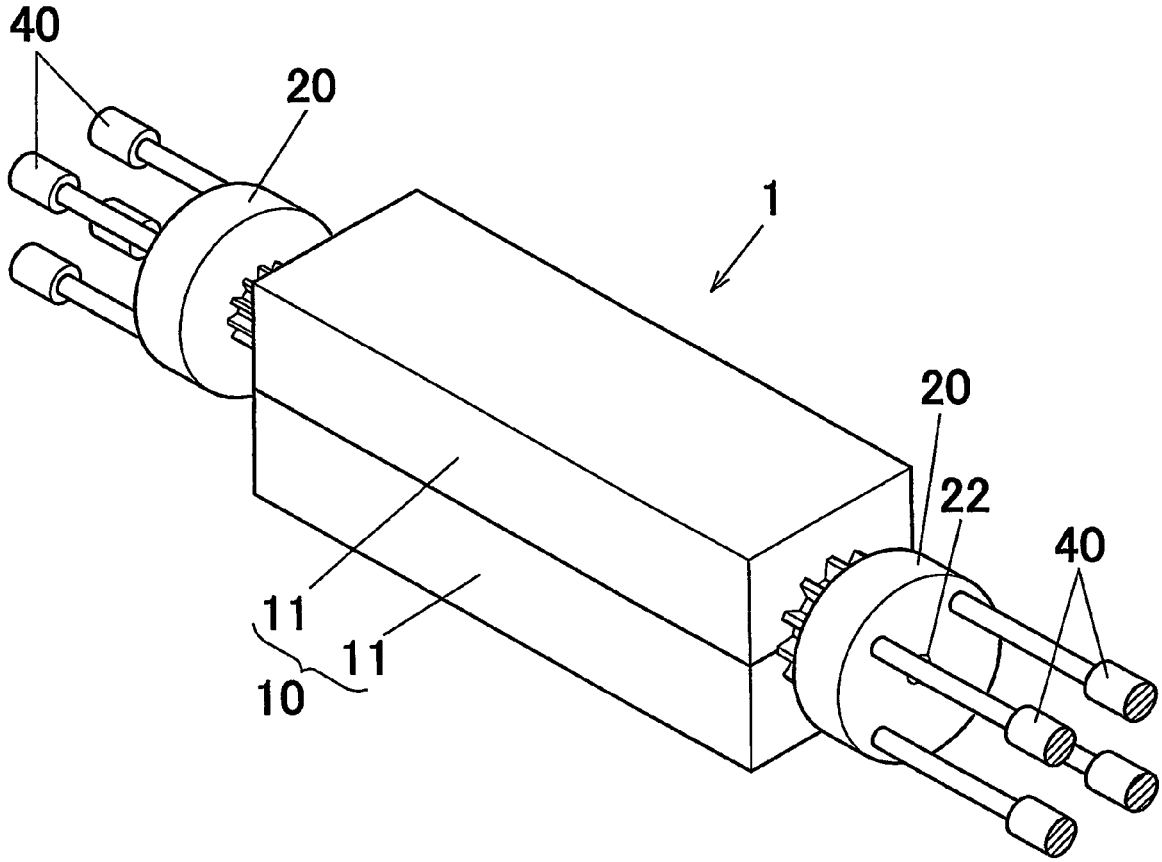
FIG. 3 is a perspective view showing the forging apparatus.

In FIG. 2, reference numeral "1" denotes a forging apparatus according to an embodiment of the present invention, and "5" denotes a raw material. In FIG. 1, reference numeral "3" denotes a forged article manufactured by the forging apparatus 1.

The forged article 3 is, as shown in FIG. 1, a bar-shaped article in which a gear portion 3*a* is formed at both axial end portions respectively. In detail, in the forged article 3 of this embodiment, a gear portion 3*a* is formed at one axial end portion and the other axial end portion. This forged article 3 is an article to be used as, for example, an automobile shaft member. In this forged article 3, each gear portion 3*a* corresponds to an enlarged diameter portion 7. On the peripheral surface of the gear portion 3*a*, a plurality of outwardly protruded cog portions 3*b* are integrally formed. In this forged article 3, the gear portion 3*a* formed at one axial end portion and the gear portion 3*b* formed at the other axial end portion are different in size. This forged article 3 is made of metal, more specifically, aluminum or aluminum alloy.

As shown in FIG. 2, the raw material 5 is a straight bar-shaped member having a round cross-section. The cross-section of the raw material 5 is constant along the entire length. One axial end portion 6 of the raw material 5 and the other axial end portion 6 of the raw material 5 are to be enlarged in diameter. In other words, one axial end portion 6 and the other axial end portion 6 are a scheduled diameter-enlarging portion, respectively. These scheduled diameter-enlarging portions 6 and 6 will be subjected to upsetting so as to be enlarged in diameter. Thus, gear portions 3*a* and 3*a* will be formed at both axial end portions of the raw material 5. The material of the raw material 5 is metal, e.g., aluminum or aluminum alloy.

In the present invention, the cross-sectional shape of the raw material 5 is not limited to a circular shape, but can be, e.g., a polygonal shape or an elliptic shape. Furthermore, the material of the raw material 5 is not limited to aluminum or aluminum alloy, and can be any metal such as copper or copper alloy or plastic. In the forging method and the forging apparatus according to the present invention, it is preferable, but not limited, that the material of the raw material 5 is aluminum or aluminum alloy.

As shown in FIG. 2, the forging apparatus 1 is used to enlarge the scheduled diameter-enlarging portions 6 and 6, which are located at both axial end portions of the raw material 5, by upsetting. The apparatus 1 is provided with a holding die 10 having two forming dented portions 17 and 17 formed at both axial end portions thereof, a pair of guides 20 and 20, a pair of punches 30 and 30, and a pair of guide moving devices 40 and 40.

Figure 5:
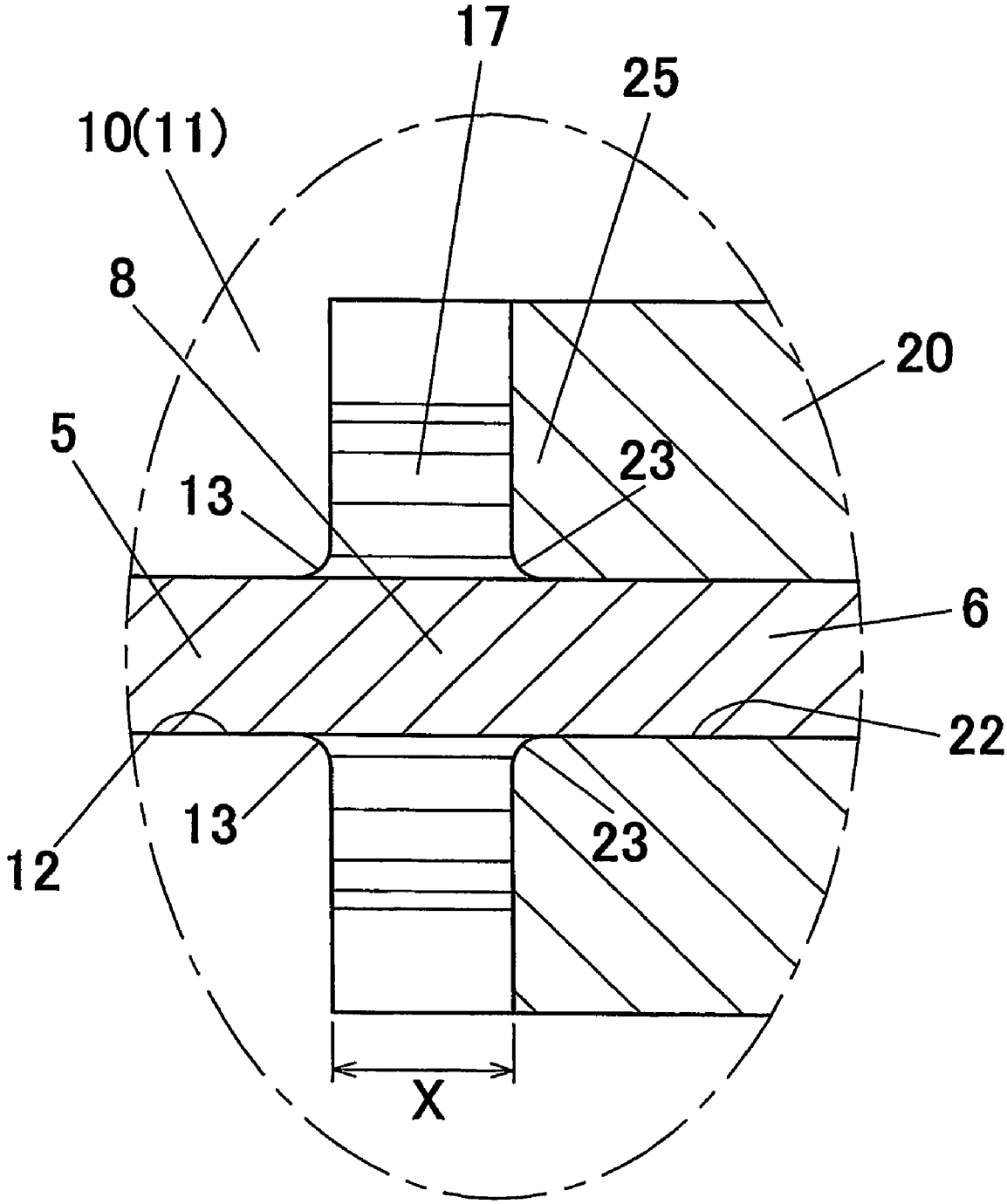
FIG. 5 is an enlarged view of the "A" portion shown in FIG. 4B.

The holding die 10 is configured to hold the axial intermediate portion of the raw material 5 in a state in which the intermediate portion is prevented from being enlarged in diameter. At an axial intermediate portion of the holding die 10, a raw material fitting aperture 12 for fitting the axial intermediate portion of the raw material 5 is provided. This raw material fitting aperture 12 extends along the axial direction of the holding die 10. The diameter of the raw material fitting aperture 12 is set to have a size capable of tightly fitting the axial intermediate portion of the raw material 5. Thus, when the axial intermediate portion of the raw material 5 is fitted in the raw material fitting aperture 12, the holding die 10 holds the axial intermediate portion of the raw material 5, so that the axial intermediate portion can be prevented from being enlarged in diameter and also prevented from being buckled. Furthermore the holding die 10 anchors the raw material 5 so as not to be moved in the axial direction at the time of upsetting. The length of the raw material fitting aperture 12 is set to have the same length as the length between the scheduled diameter-enlarging portions 6 and 6. As shown in FIG. 5, the edge portions of the raw material fitting aperture 12 are chamfered along the entire periphery thereof. Thus, the cross-sectional shape of each edge portion is formed into a round shape. In FIG. 5, reference numeral "13" denotes a chamfered portion formed at the edge portion.

The pair of forming dented portions 17 and 17 are formed at axial end portions of the holding die 10 so as to communicated with end portions of the raw material fitting aperture 12. Each forming dented portion 17 is configured to form the gear portion 3*a* of the forged article 3. Therefore, the cross-sectional shape of each forming dented portion 17 is formed into a cross-sectional shape corresponding to the cross-sectional shape of the gear portion 3*a*. Accordingly, on the peripheral surface of each forming dented portion 17, a plurality of cog portion forming grooves 17*b* are formed.

The holding die 10 is divided into plural portions along a dividing face so as to divide the raw material fitting aperture 12 and the forming dented portions 17 and 17. That is, the holding die 10 is a divided assembling type (i.e., divided dies). In this embodiment, the holding die 10 is divided into an upper segment and a lower segment. These two segments constituting this holding die 10 are the same in shape and size.

In the present invention, the holding die 10 is not limited to a die divided into two segments, but can be divided into three segments, four segments, or five or more segments. In other words in the present invention, the dividing number and the dividing positions will be determined depending on a shape of a forged article 3. In this embodiment, for an explanation purpose, a two-divided holding die 10 is used.

Each guide 20 has an insertion passage 22 in which the corresponding scheduled diameter-enlarging portion 6 of the raw material 5 is inserted. Each guide 20 is configured to guide the material of the scheduled diameter-enlarging portion 6 inserted in the insertion passage 22 to the forming dented portion 17 at the time of upsetting. In this embodiment, this insertion passage 22 is an insertion aperture.

Furthermore, the insertion passage 22 of each guide 20 is formed in the guide 20 so as to penetrate the guide 20 along the axial direction thereof, i.e., the axial direction thereof. The diameter of this insertion passage 22 is formed to have a size capable of tightly and slidably fitting the scheduled diameter-enlarging portion 6 of the raw material 5. The length of the insertion passage 22 is set to have the same length as that of the scheduled diameter-enlarging portion 6 of the raw material 5. Since the diameter and the length of the insertion passage 22 are set as mentioned above, when the scheduled diameter-enlarging portion 6 is inserted into the insertion passage 22 of the guide 20, the insertion passage 22 holds the scheduled diameter-enlarging portion 6 of the raw material 5 in a manner such that the scheduled diameter-enlarging portion 6 is prevented from being buckled.

In the present invention, the length of the insertion passage 22 can be set to have a length longer than that of the scheduled diameter-enlarging portion 6.

Figure 4A:
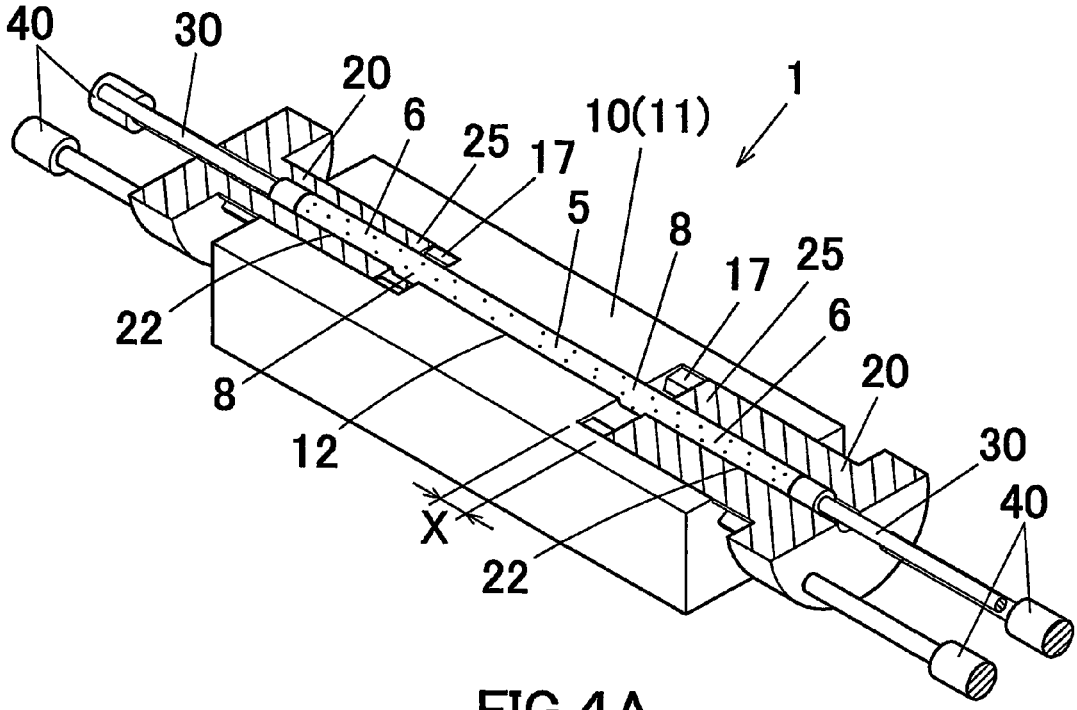
FIG. 4A is a perspective view showing the state before subjecting a raw material to forging processing to enlarge predetermined portions of the raw material in diameter.
Figure 4B:
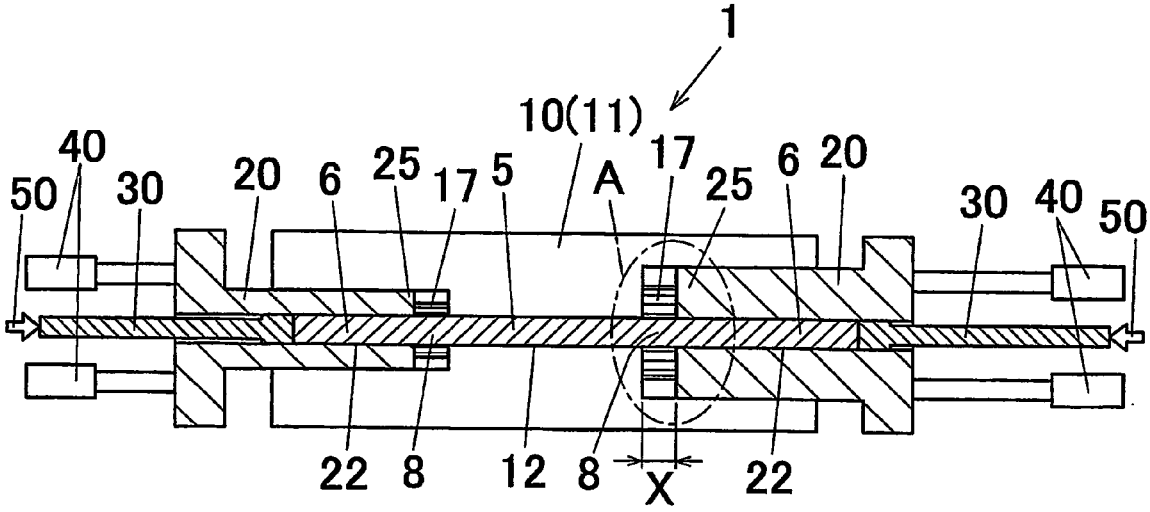
FIG. 4B is a cross-sectional view corresponding to FIG. 4A showing the state before subjecting a raw material to forging processing to enlarge predetermined portions of the raw material in diameter.

At the end portion of each guide 20, a pressing portion 25 as a male die to be fitted in the corresponding forming dented portion 17 is provided. This pressing portion 25 is used to press the material filled in the forming dented portion 17. The cross-sectional shape of this pressing portion 25 has a shape corresponding to the cross-sectional shape, or the same shape as the cross-sectional shape of the forming dented portion 17. Thus, the pressing portion 25 can be fitted in the forming dented portion 17 in a fitted and axially slidable manner. In the state in which the pressing portion 25 is fitted in the forming dented portion 17, as shown in FIGS. 4A and 4B, the opening of the forming dented portion 17 is closed by the pressing portion 25.

As shown in FIG. 5, the edge portion of each guide 20 at the side of the insertion passage 22 is chamfered along the entire periphery thereof to have a rounded portion. In FIG. 5, reference numeral "23" denotes a chamfered portion formed at the edge portion.

Each punch 30 is configured to press (apply pressure) corresponding scheduled diameter-enlarging portion 6 of the raw material 5. This punch 30 is inserted in the insertion passage 22 of the guide 20 in a fitted and axially slidable manner.

Furthermore, this forging apparatus 1 is provided with a pressing device (not sown) for applying pressing force to each punch 30. This pressing device is connected to the punch 30 so as to apply pressing force to the punch 30 by fluid pressure (e.g., oil pressure, gas pressure). Furthermore, this pressing device can control the moving rate (speed) of the punch 30, i.e., the pressing rate (speed) of the scheduled diameter-enlarging portion 6 of the raw material 5 by the punch 30.

Each guide moving device 40 is connected to corresponding guide 20 so that the guide 20 can be moved at a predetermined rate (speed) in a direction opposite to the moving direction 50 of the punch 30. Each guide moving device 40 moves the guide 20 with a fluid pressure cylinder (e.g., oil pressure cylinder, gas pressure cylinder). Each guide moving device 40 can control the moving rate (speed) of the guide 20. The guide moving device 40 presses the material filled in the forming dented portion 17 by controlling the moving rate (speed) of the guide and/or controlling the position with respect to the forming dented portion 17 of the guide 20.

In the present invention, each guide moving device 40 can be configured so as to press the material filled in the forming dented portion 17 with spring force or another means.

Next, a forging method using the forging apparatus 1 of the aforementioned embodiment will be explained as follows.

In the forging apparatus 1 of this embodiment, as mentioned above, the pressing portion 25 of the guide 20 is fitted in the forming dented portion 17 to thereby close the forming dented portion 17. Accordingly, the forging method of this embodiment does not fall within a category of a free upset forging method or a partially restrain upset forging method, but fall within a category of a close upset forging method.

In FIG. 4A, FIG. 6A, FIG. 7A and FIG. 8A, for the explanation purpose, the upper segment 11 among two segments 11 and 11 constituting the holding die 10 is not illustrated.

As shown in FIG. 2, FIG. 3, FIG. 4A and FIG. 4B, the axial intermediate portion of the raw material 5 is fitted in the raw material fitting aperture 12 of the holding die 10 and the scheduled diameter-enlarging portions 6 and 6 are fitted in the corresponding forming dented portions 17 and 17. In this state, the axial intermediate portion of the raw material 5 is held by the holding die 10 in a state in which the intermediate portion is prevented from being enlarged in diameter and also prevented from being buckled. Furthermore, the raw material 5 is fixed to the holding die 10 so as not to be moved in the axial direction thereof at the time of upsetting.

Furthermore, the scheduled diameter-enlarging portions 6 and 6 of the raw material 5 fitted in the forming dented portions 17 and 17 is inserted into corresponding insertion passages 22, and the pressing portion 25 of each guide 20 is disposed in corresponding forming dented portion 17.

As shown in FIG. 4A and FIG. 4B, an initial clearance X is formed between each guide 20 and the holding die 10, in detail, between the tip end face of each guide 20 (i.e., the tip pressing face of the pressing portion 25) and the bottom face of the forming dented portion 17 of the holding die 10. In the state in which the punch 30 is not initiated to move, in other words, in the state in which the pressing of the scheduled diameter-enlarging portion 6 of the raw material 5 with the punch 30 is not initiated, the distance (range) of the initial clearance X is set to be a length shorter than the buckling limit length at the cross-sectional area of the exposed portion 8 of the raw material 5 exposed between each guide 20 and the holding die 10. In the present invention, the buckling limit length denotes a buckling limit length by punch pressing force. Thereafter, each scheduled diameter-enlarging portion 6 of the raw material 5 is heated with a heating device (not shown).

Subsequently, both the scheduled diameter-enlarging portions 6 and 6 are simultaneously pressed in the axial direction thereof with the corresponding punch 30 to thereby fill the material of each scheduled diameter-enlarging portion 6 in the corresponding forming dented portion 17, while both the guides 20 and 20 are moved in a direction opposite to the moving direction 50 of the corresponding punch 30 so that the length of each exposed portion 8 of the raw material 5 becomes less than the buckling limit length at the cross-sectional area of each exposed portion 8 of the raw material 5. At this time, a time-lag is set between the initiation of the movement of each punch 30 and the initiation of the movement of the guide 20.

Figure 6A:
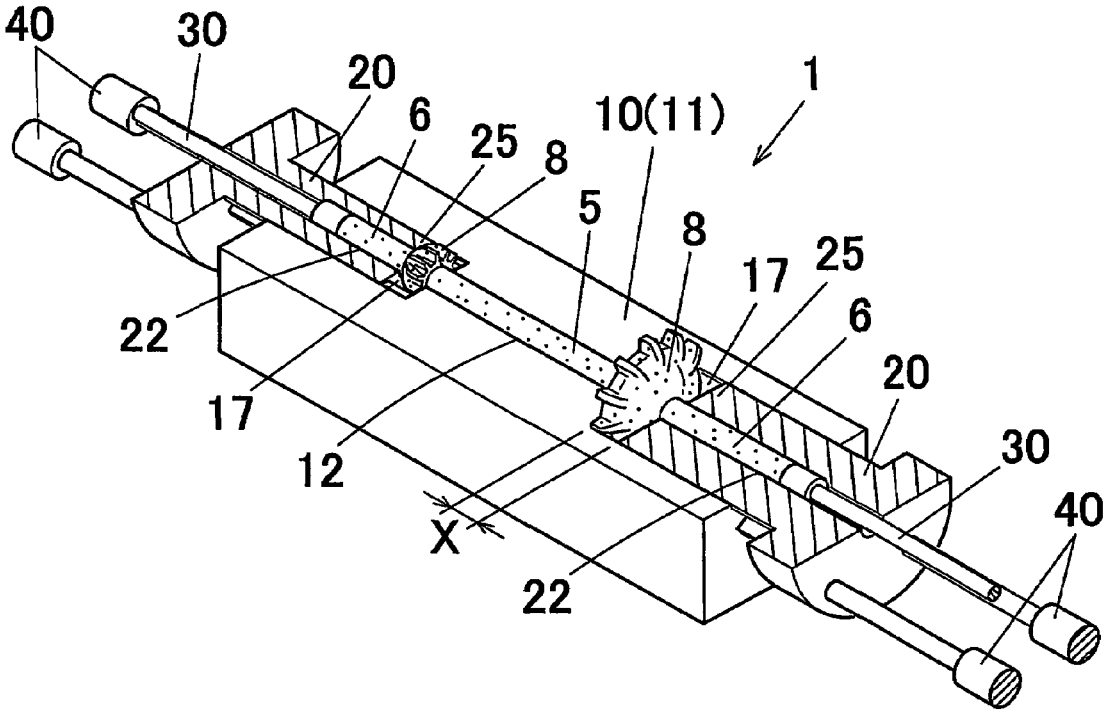
FIG. 6A is a perspective view showing the state in which the raw material is being subjected to forging processing to enlarge predetermined portions of the raw material in diameter.
Figure 6B:
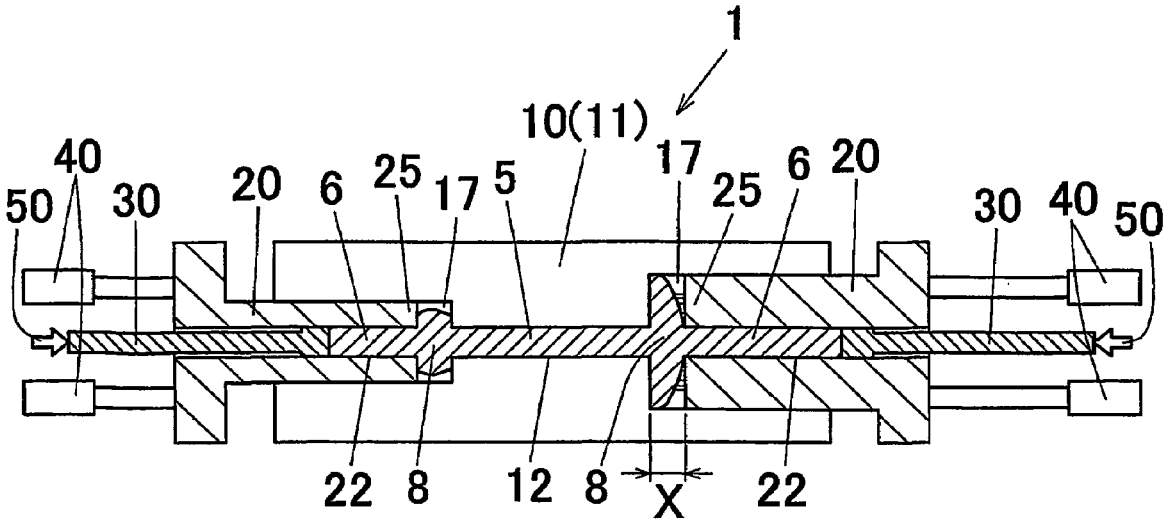
FIG. 6B is a cross-sectional view corresponding to FIG. 6A showing the state in which the raw material is being subjected to forging processing to enlarge predetermined portions of the raw material in diameter.

That is, in cases where the pressing of the scheduled diameter-enlarging portion 6 of the raw material 5 with the punch 30 is initiated, the position of each guide 20 is fixed, and then both the punches 30 and 30 are simultaneously moved to thereby simultaneously press the scheduled diameter-enlarging portions 6 and 6 with the corresponding punch 30. By these steps, as shown in FIG. 6A and FIG. 6B, the material of each scheduled diameter-enlarging portion 6 is filled in the space of the initial clearance X in the corresponding forming dented portion 17.

Then, the pressure of the material in the forming dented portion 17 increases. Thus, back pressure of the material in the forming dented portion 17 will be applied to the guide 20 and the material in the forming dented portion 17 will be pressed against the pressing portion 25.

Figure 7A:
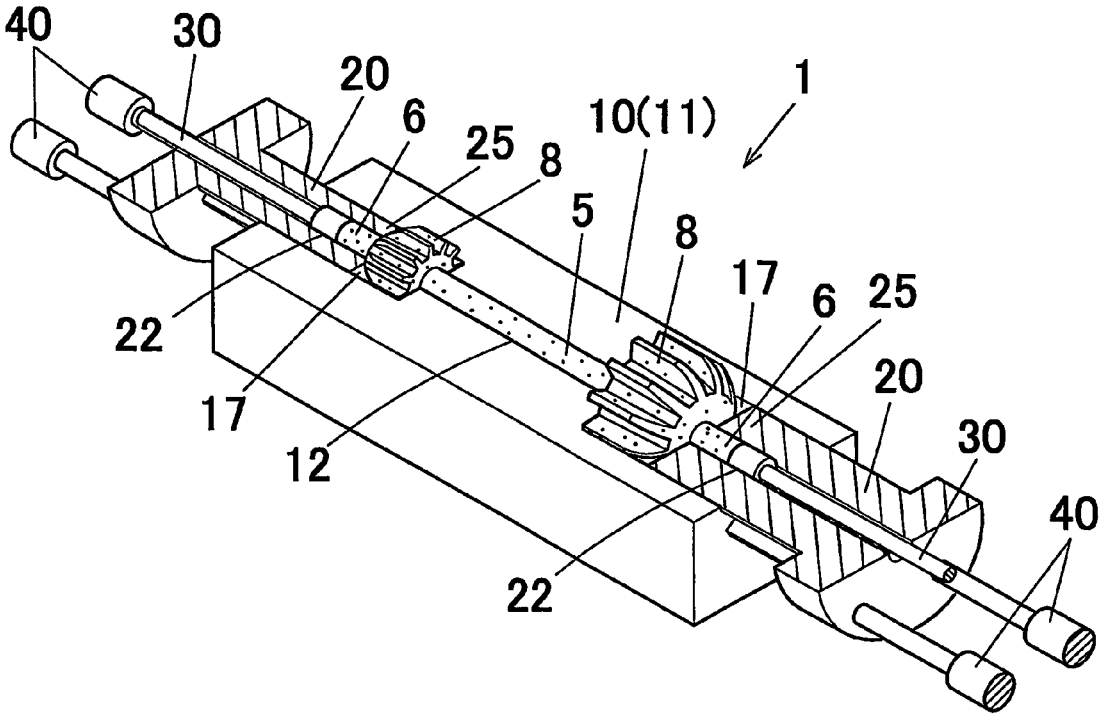
FIG. 7A is a perspective view showing the state in which the raw material is being subjected to forging processing to enlarge predetermined portions of the raw material in diameter.
Figure 7B:
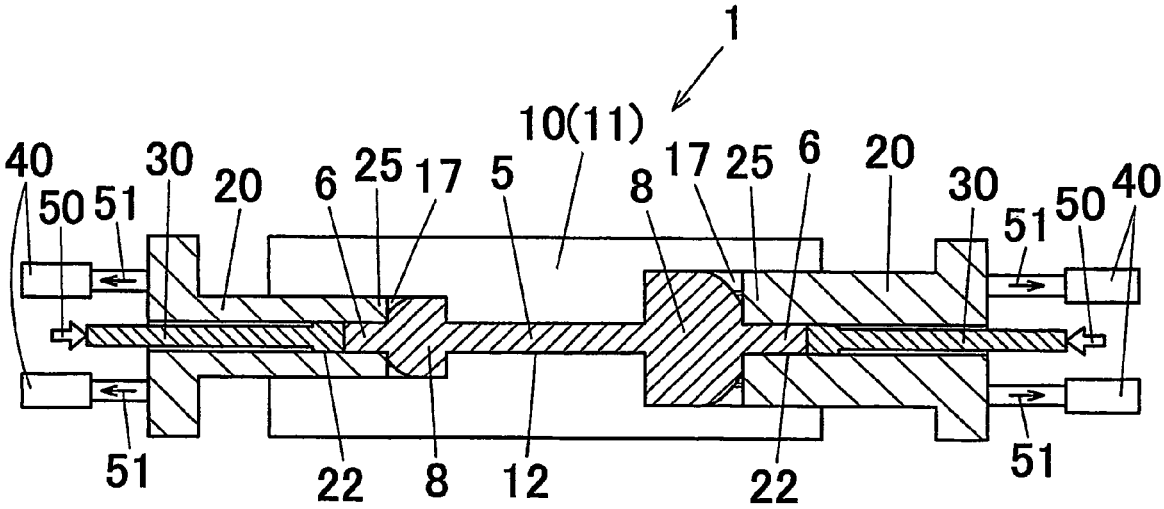
FIG. 7B is a cross-sectional view corresponding to FIG. 7A showing the state in which the raw material is being subjected to forging processing to enlarge predetermined portions of the raw material in diameter.

After the certain time-lag has passed, while continuously pressing the scheduled diameter-enlarging portions 6 and 6 with corresponding punch 30 and 30 with the pressing state of the material in the forming dented portion 17 by the pressing portion 25 of each guide 20 maintained, as shown in FIGS. 7A and 7B, each guide 20 and 20 is moved in a direction opposite to the moving direction 50 of corresponding punch 30. It is preferable that both the guides 20 and 20 are simultaneously moved. In these figures, reference numeral "51" denotes a moving direction of the guide 20.

The pressure for filling the material in the forming dented portion 17 at the time of initiation of movement of each guide 20 is set arbitrary depending on, for example, the shape of the enlarged diameter portion 7 and the shape of the pressing portion 25 of the guide 20.

Furthermore, the moving rate (speed) of each guide 20 is controlled arbitrary depending on the shape of the scheduled diameter-enlarging portion 6 and the shape of the pressing portion 25 of the guide 20. This moving rate control results in an accurate forging which does not generate shape defects such as material unfilled defects.

In the present invention, the moving rate of each punch 30 can be constant or variable. In the same manner, the moving rate of each guide 20 can be constant or variable.

In the present invention, the moving rate of each guide 20 can be controlled by corresponding guide moving device 40 so that the pressing force against the material by the pressing portion 25 of each guide 20 becomes a predetermined set value (e.g., constant). The moving rate of each guide 20 can be controlled by corresponding guide moving device 40 so that the filling pressure of the material in the forming dented portion 17 becomes a predetermined set value (e.g., constant).

Figure 8A:
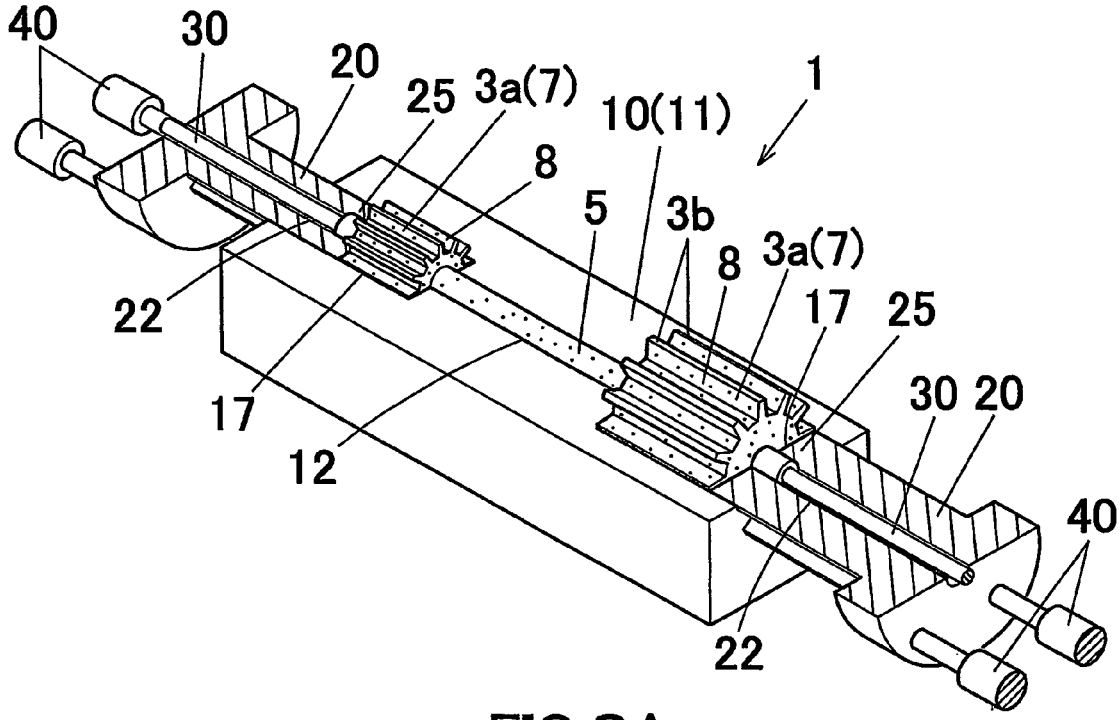
FIG. 8A is a perspective view showing the state after the predetermined portions is enlarged.
Figure 8B:
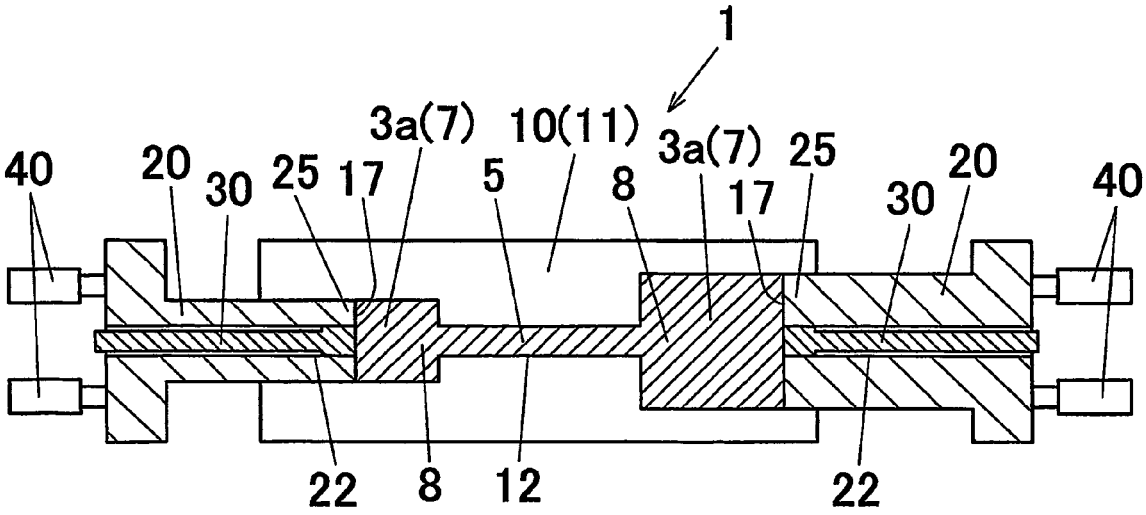
FIG. 8B is a cross-sectional view corresponding to FIG. 8A showing the state after the predetermined portions is enlarged.

In accordance with the movement of the punch 30 and that of the guide 20, each scheduled diameter-enlarging portion 6 of the raw material 5 is gradually enlarged in diameter (see FIG. 7A and FIG. 7B). Furthermore, as shown in FIG. 8A and FIG. 8B, when the tip end of each punch 30 reaches the tip end position of the guide 20, each scheduled diameter-enlarging portion 6 of the raw material 5 is fully enlarged in diameter. Thus, a predetermined gear-shaped portion can be obtained.

Thereafter, by removing the raw material 5 from the holding die 10, the desired forged article 3 as shown in FIG. 1 can be obtained.

Thus, according to the forging method of the aforementioned embodiment, by simultaneously pressing the scheduled diameter-enlarging portion 6 and 6 of the raw material 5 with respective punch 30 to fill the material of each scheduled diameter-enlarging portion 6 in the forming dented portion 7, the scheduled diameter-enlarging portions 6 and 6 of both axial end portions of the raw material 5 are simultaneously enlarged in diameter. Accordingly, a forged article 3 in which enlarged diameter portions 7 and 7 are formed at both axial end portions can be manufactured efficiently, resulting in a reduced manufacturing cost.

Furthermore, by moving each guide 20 in a direction opposite to a moving direction of corresponding punch 30 while filling the material in the forming dented portion 17, the material flow in the forming dented portion 17 is dispersed. Therefore, the material can be filled in the corner portions of the forming dented portion 17, or it is possible to prevent the problem of causing material unfilled portion in the forming dented portion 17, without excessively increasing the forming pressure. Accordingly, the occurrence of shape-defects such as material unfilled defects can be prevented and a high quality forged article 3 can be obtained.

Furthermore, by moving each guide 20 in a direction opposite to a moving direction 50 of respective punch 30, the load to be applied to the forming dented portion 17 can be decreased. As a result, the durability of the forming dented portion 17, i.e., the durability of the holding die 10, can be extended.

Furthermore, since the insertion passage 22 of each guide 20 is configured to hold the scheduled diameter-enlarging portion 6 in a buckle preventing state, a possible buckle of the diameter-enlarging portion 6 which may occur at the time of pressing the diameter-enlarging portion 6 with the punch 30 (i.e., at the time of upsetting) can be prevented, which in turn can prevent occurrence of shape-defects such as wrinkles or tucking. As a result, a forged article 3 with higher quality can be obtained.

Since a certain initial clearance X is provided between each guide 20 and the holding die 10 immediately before the initiation of movement of each punch 30 (i.e., immediate before the initiation of the pressing of the scheduled diameter-enlarging portion 6 with each punch 30), it is possible to prevent defects that the exposed portion 8 of the raw material 5 exposed within the initial clearance X between each guide 20 and the holding die 10 immediately after the initiation of movement of each punch 30 (i.e., immediate after the initiation of the pressing of the scheduled diameter-enlarging portion 6 with each punch 30). Furthermore, the moving length (i.e., stroke) of each guide 20 can be shortened.

Furthermore, since a time-lag is set between initiation of movement of each punch 30 and initiation of movement of each guide 20, the cross-sectional area of the exposed portion 8 of the raw material 5 increases immediately after the initiation of movement of each punch 30. As a result, the buckle limit length of the exposed portion 8 of the raw material 5 can be increased, and therefore the occurrence of buckle of the raw material 5 can be prevented assuredly.

Furthermore, since the pressing portion 25 is provided at the tip end portion of each guide 20, the material filled in the forming dented portion 17 can be pressed with the pressing portion 25. Therefore, the material can be assuredly filled in the corner portions of the forming dented portion 17, which in turn can assuredly prevent occurrence of defects which may generate a material unfilled portion in the forming dented portion 17. As a result, a forged article 3 with high quality can be obtained.

Furthermore, when the pressing portion 25 of each guide 20 is fitted in the forming dented portion 17, the forming dented portion 17 is closed. Therefore, it is not necessary to execute burr removing processing after the processing (swaging processing), and therefore the number of steps can be decreased and the manufacturing efficiency can be increased as well.

Furthermore, since the insertion passage side edge portion of a tip end of each guide 20 is chamfered, the guide 20 efficiently receives the back pressure of the material in the forming dented portion 17 at the time of processing. As a result, the driving force required to move the guide 20 in a predetermined direction can be decreased. Thus, the guide 20 can be moved with smaller driving force, which makes it possible to miniaturize the guide moving device 40. Furthermore, since the edge portion of the material fitting aperture 12 of the holding die 10 is chamfered, the stress concentration which may occur at a corner portion between the axial intermediate portion and the enlarged diameter portion 7 of the forged article 3 can be decreased.

Although a preferable embodiment of the present invention was explained, the present invention is not limited to the above.

For example, in the present invention, the scheduled diameter-enlarging portion 6 of the raw material 5 can be enlarged in diameter with the raw material 5 heated. Alternatively, the scheduled diameter portion 6 of the raw material 5 can be enlarged in diameter with the raw material 5 unheated. In other words, the forging method according to the present invention can be either a hot rolling forging method or a cold rolling forging method.

Furthermore, the enlarged diameter portion 7 formed at one axial end portion of the forging article 3 and that formed at the other axial end portion of the forging article 3 can be same or different in shape and also can be same or different in size.

Figure 9:
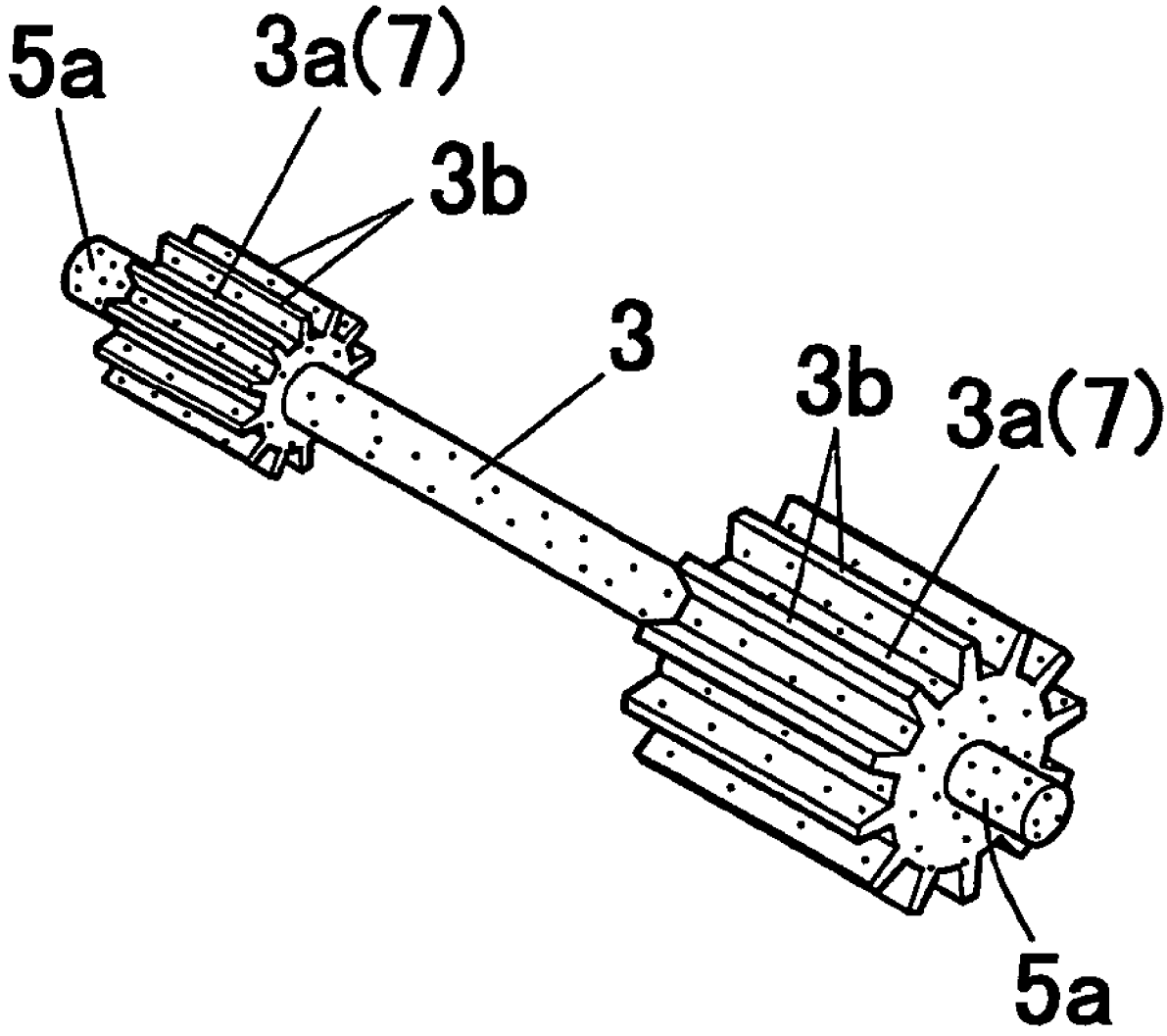
FIG. 9 is a perspective view showing another forged article manufactured by the forging apparatus.
Figure 10:
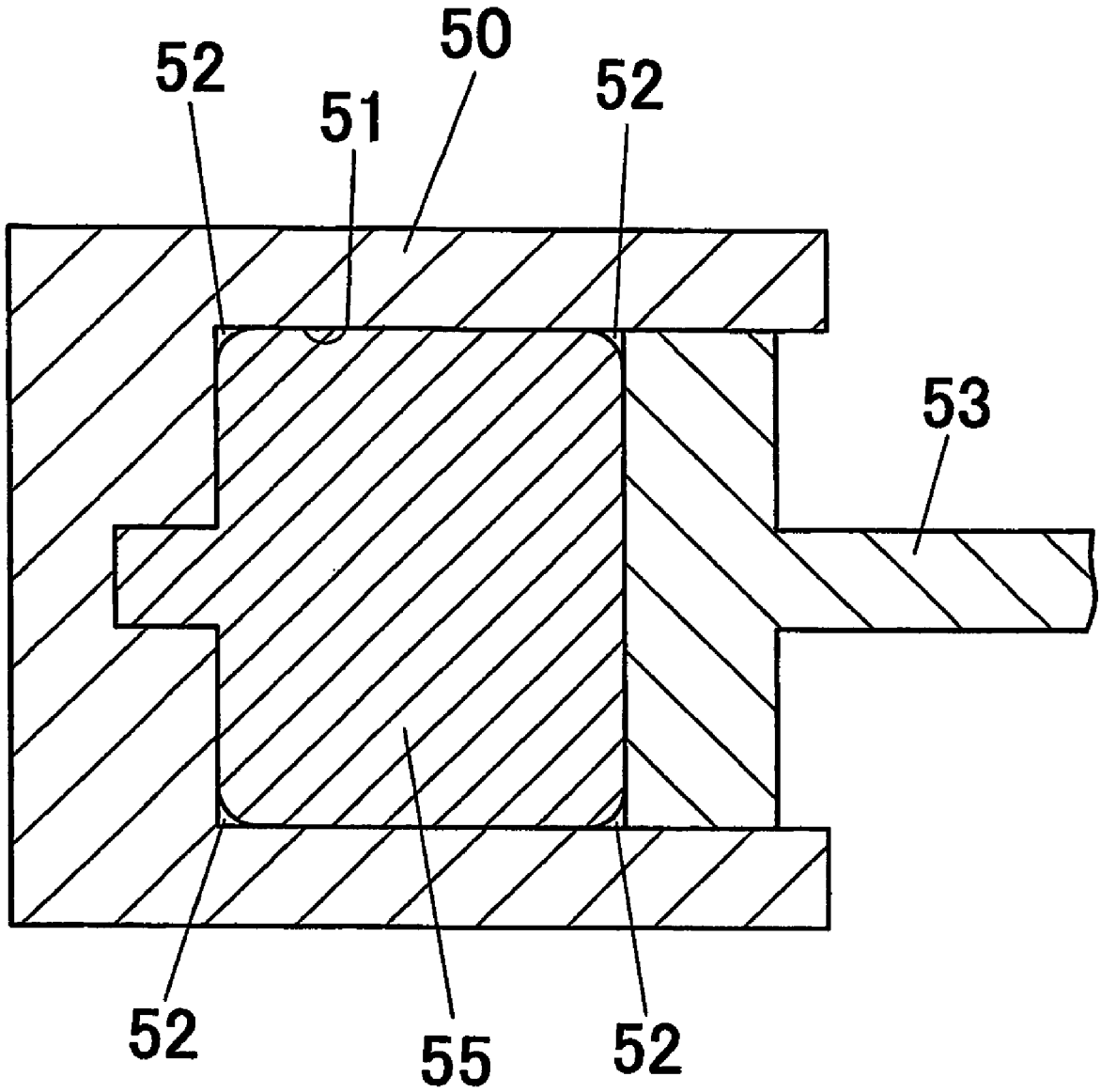
FIG. 10 is an explanatory cross-sectional view showing a forging apparatus for explaining defects of a conventional upsetting method.

Furthermore, in the present invention, as shown in FIG. 9, the forged article 3 to be manufactured by the forging method of the present invention can have an enlarged diameter portion 7 at axial end portions of the forged article 3 and non-upset portion 5*a* at outermost end portions outside the axial end portions. Alternatively, as shown in FIG. 1, the forged article 3 can have, at its end portions, enlarged diameter portions 7 with no non-upset portions.

According to the former forged article 3 (i.e., the forged article shown in FIG. 9), in cases where a predetermined portion such as the enlarged diameter portion 7 of the forged article 3 is to be subjected to after-processing, the non-upset portion 5*a* can be chucked, which makes it easy to execute the after-processing.

According to the latter forged article 3 (i.e., the forged article shown in FIG. 1), since no non-upset portion exists at the end portions of the forged article 3, it is not necessary to execute processing to the non-upset portion, resulting in a reduced number of steps.

Furthermore, a forged article 3 to be obtained by the forging method according to the present invention is not limited to the aforementioned embodiment, but can be, for example, an automobile arm member, a shaft member, a connecting rod or a double-head piston for compressors.

In cases where a forged article 3 to be obtained by the forging method according to the present invention is an automobile arm member (e.g., a suspension arm member, an engine mount member or a sub-frame), the forging method of the present invention can be expressed as follows.

That is, a method for manufacturing an automobile arm member in which scheduled diameter-enlarging portions located at axial end portions of a bar-shaped raw material are enlarged in diameter by upsetting, the forging method, comprising the steps of:

holding an axial intermediate portion of the raw material with a holding die in a state in which the axial intermediate portion is prevented from being enlarged in diameter, disposing the axial end portions of the raw material in forming dented portions formed at axial end portions of the holding die, and disposing the scheduled diameter-enlarging portions in insertion passages formed in guides; and then simultaneously pressing the scheduled diameter-enlarging portions with punches to fill the material of the scheduled diameter-enlarging portions in the forming dented portions while moving each guide in a direction opposite to a moving direction of each punch, thereby enlarging each scheduled diameter-enlarging portion in diameter.

In this case, the scheduled diameter portion of the raw material can be a scheduled joint portion to be connected to another member. Such a joint portion is provided with, for example, a bush-mounting portion to which a bush is mounted. Such a bush-mounting portion is, for example, a cylindrical member.

In cases where a forged article 3 to be obtained by the forging method according to the present invention is an automobile shaft member (e.g., a propeller shaft member), the forging method of the present invention can be expressed as follows.

That is, a method for manufacturing a propeller shaft member in which scheduled diameter-enlarging portions located at axial end portions of a bar-shaped raw material are enlarged in diameter by upsetting, the forging method, comprising the steps of:

holding an axial intermediate portion of the raw material with a holding die in a state in which the axial intermediate portion is prevented from being enlarged in diameter, disposing the axial end portions of the raw material in forming dented portions formed at axial end portions of the holding die, and disposing the scheduled diameter-enlarging portions in insertion passages formed in guides; and then simultaneously pressing the scheduled diameter-enlarging portions with punches to fill the material of the scheduled diameter-enlarging portions in the forming dented portions while moving each guide in a direction opposite to a moving direction of each punch, thereby enlarging each scheduled diameter-enlarging portion in diameter.

In this case, the scheduled diameter portion of the raw material can be, for example, a scheduled joint portion to be connected to another member.

In cases where a forged article 3 to be obtained by the forging method according to the present invention is an automobile connecting rod member, the forging method of the present invention can be expressed as follows.

That is, a method for manufacturing an automobile connecting rod member in which scheduled diameter-enlarging portions located at axial end portions of a bar-shaped raw material are enlarged in diameter by upsetting, the forging method, comprising the steps of:

holding an axial intermediate portion of the raw material with a holding die in a state in which the axial intermediate portion is prevented from being enlarged in diameter, disposing the axial end portions of the raw material in forming dented portions formed at axial end portions of the holding die, and disposing the scheduled diameter-enlarging portions in insertion passages formed in guides; and then simultaneously pressing the scheduled diameter-enlarging portions with punches to fill the material of the scheduled diameter-enlarging portions in the forming dented portions while moving each guide in a direction opposite to a moving direction of each punch, thereby enlarging each scheduled diameter-enlarging portion in diameter.

In this case, the scheduled diameter portion of the raw material can be, for example, a scheduled joint portion to be connected to another member (e.g., a crank, piston).

In cases where a forged article 3 to be obtained by the forging method according to the present invention is a double-headed piston for compressors, the forging method of the present invention can be expressed as follows.

That is, a method for manufacturing a double-headed piston for compressors in which scheduled diameter-enlarging portions located at axial end portions of a bar-shaped raw material are enlarged in diameter by upsetting, the forging method, comprising the steps of:

holding an axial intermediate portion of the raw material with a holding die in a state in which the axial intermediate portion is prevented from being enlarged in diameter, disposing the axial end portions of the raw material in forming dented portions formed at axial end portions of the holding die, and disposing the scheduled diameter-enlarging portions in insertion passages formed in guides; and then simultaneously pressing the scheduled diameter-enlarging portions with punches to fill the material of the scheduled diameter-enlarging portions in the forming dented portions while moving each guide in a direction opposite to a moving direction of each punch, thereby enlarging each scheduled diameter-enlarging portion in diameter.

In this case, the scheduled diameter portion of the raw material can be, for example, a head portion of a scheduled double-headed piston (i.e., a piston main body) to be connected to another member.

INDUSTRIAL APPLICABILITY

A forging method and apparatus according to the present invention can be preferably used to manufacture, for example, an automobile arm member, an automobile shaft member, an automobile connecting rod and/or a double-headed piston for compressors. A forged article of the present invention can be preferably used as, for example, an automobile arm member, an automobile shaft member, an automobile connecting rod and/or a double-head piston for compressors.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" is meant as a non-specific, general reference and may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

The invention claimed is:

1. A forging method for enlarging scheduled diameter-enlarging portions which are located at axial end portions of a bar-shaped raw material, the forging method comprising the steps of:

holding an axial intermediate portion of the raw material with a holding die in a state in which the axial intermediate portion is prevented from being enlarged in diameter, and the axial end portions of the raw material are disposed in respective forming dented portions provided at axial end portions of the holding die;

providing a guide in each dented portion of the holding die such that the scheduled diameter-enlarging portions are provided in insertion passages formed in the respective guides and the guides are axially movable within the dented portions; and simultaneously pressing the respective scheduled diameter-enlarging portions with punches in an axial direction of the raw material to fill the material of the scheduled diameter-enlarging portions in the forming dented portions while moving each guide in a direction opposite to a moving direction of each punch, thereby enlarging each scheduled diameter-enlarging portion in diameter, wherein each insertion passage is configured to hold the schedule diameter-enlarging portion inserted therein so as to prevent buckling of the scheduled diameter-enlarging portion when the schedule diameter-enlarging portion is pressed in the axial direction.

2. The forging method as recited in claim 1, wherein an initial clearance having a distance less than a buckle limit length at a cross-sectional area of an exposed portion of the material is set between each guide and the holding die before initiation of movement of each punch, wherein the buckle limit length is the minimum length at which buckling occurs in the exposed portion of the raw material when the scheduled diameter-expanding portion of the raw material is pressed under predetermined pressing force with the punch in the axial direction of the raw material.

3. The forging method as recited in claim 2, wherein a time-lag is set between initiation of movement of each punch and initiation of movement of each guide.

4. The forging method as recited in claim 1, wherein each guide is provided with a pressing portion to be fitted in the forming dented portion at a tip end portion of the guide.

5. The forging method as recited in claim 1, wherein an insertion passage side edge portion of a tip end of each guide and/or an edge portion of a raw material fitting aperture of the holding die for fitting the axial intermediate portion of the raw material are chamfered.

6. A forging apparatus for enlarging scheduled diameter-enlarging portions which are axial end portions of a bar-shaped raw material, comprising:

a holding die for holding an axial intermediate portion of the raw material in a state in which the axial intermediate portion is prevented from being enlarged in diameter;

two forming dented portions in which a respective scheduled diameter-enlarging portion is to be disposed, the forming dented portions being formed at axial end portions of the holding die;

two guides each having an insertion passage in which the scheduled diameter-enlarging portion is inserted, the guides being axially movable within the dented portions; and two punches for simultaneously pressing the scheduled diameter-enlarging portions in an axial direction of the raw material, wherein each guide is capable of moving in a direction opposite to a moving direction of each punch, and wherein the insertion passage of each guide is configured to hold the scheduled diameter-enlarging portion inserted therein so as to prevent buckling of the scheduled diameter-enlarging portion when the scheduled diameter-enlarging portion is pressed in the axial direction.

7. The forging apparatus as recited in claim 6, further comprising two guide moving devices each for moving the guide in a direction opposite to a moving direction of the punch, each guide moving device being connected to corresponding guide.

8. The forging apparatus as recited in claim 6, wherein each guide is provided with a pressing portion to be fitted in a forming dented portion at a tip end portion of the guide.

9. The forging apparatus as recited in claim 6, wherein an insertion passage side edge portion of a tip end of each punch and/or an edge portion of a raw material fitting aperture of the holding die for fitting the axial intermediate portion are chamfered.

* * * * *